United States Patent [19]

Minear et al.

[11] Patent Number: 4,673,033

[45] Date of Patent: Jun. 16, 1987

[54] TUBING CONVEYED PERFORATING ASSEMBLY SAFETY DEVICE

[75] Inventors: John W. Minear; Raymond J. McNiece, both of Houston, Tex.

[73] Assignee: Delaware Halliburton Company, Duncan, Okla.

[21] Appl. No.: 793,431

[22] Filed: Oct. 31, 1985

[51] Int. Cl.[4] ..... E21B 43/11

[52] U.S. Cl. ..... 166/55.1; 175/4.55

[58] Field of Search ..... 166/55.1, 55.2, 55, 166/63, 297, 299; 175/4.51, 4.54, 4.55

[56] References Cited

U.S. PATENT DOCUMENTS 3,208,378 9/1965 Boop ..... 175/4.55

3,773,120 11/1973 Stroud et al. ..... 175/4.55

4,208,966 6/1980 Hart ..... 175/4.55 X

*Primary Examiner*—Stephen J. Novosad

*Assistant Examiner*—Thuy M. Bui

*Attorney, Agent, or Firm*—William J. Beard

[57] ABSTRACT

For use in a tubing conveyed perforating gun assembly, the assembly including N shaped charges, a safety device is disclosed. In the preferred and illustrated embodiment, the safety device includes an N+1 shaped charge positioned to destroy a transmitter means forming a signal transmitted up the well. The transmitter means is secured within a cylindrical housing closed by a sacrificial cover, all assembled to the TCP gun assembly.

11 Claims, 2 Drawing Figures

TUBING CONVEYED PERFORATING ASSEMBLY SAFETY DEVICE

BACKGROUND OF THE DISCLOSURE

During the completion of a well which has been successfully drilled to a producing formation, it is necessary to perforate into the formation. Perforations are formed by shaped charges. One procedure for positioning shaped charges in the well borehole is to suspend an assembly known as a tubing conveyed perforating gun assembly. The TCP assembly is lowered into the borehole on a tubing string, and a weight is normally dropped down the tubing to land on the top of the TCP apparatus. This detonates the explosive charge equipment at the top of the TCP assembly and initiates burning of a primer cord extending along the shaped charges. The number of shaped charges can be varied widely. It is conceivable that the shaped charges will number in the hundreds, requiring a very long primer cord.

After the equipment is suspended several thousand feet deep in a well, the operator then normally drops the weighted bar in the tubing to initiate detonation. Detonation is fairly easy to detect at the surface. There is, however, always a sense of uncertainty of whether or not all the shaped charges have been detonated. At the time of retrieving the TCP gun assembly, the tubing is first retrieved. Then, the spent shaped charges in the support assembly is retrieved. This creates a dangerous moment at the wellhead when the gun assembly is pulled out of the well. This exposes personnel to great danger in the event that one of the shaped charges did not detonate. One mode of failure results from interruption of the primer cord. It is perhaps the most common mode of failure in shaped charge detonation. That is, the shaped charges at the top end of the assembly are all detonated. Several bottom located shaped charges are not detonated. This may happen with only a few shaped charges or may involve a very large number of large number of shaped charges. The failure to detonate all the shaped charges creates a significant hazard on retrieving the assembly from the well borehole.

It has been discovered that the last shaped charge in the string, the charge located at the bottom of the string, is the shaped charge to be investigated. Of all the charges in the string, this is the particular shaped charge that is most likely involved in the event there is a failure in the equipment at any point in the assembly. This is true whether or not the assembly comprises only a few shaped charges or several hundred shaped charges. That is, when the last charge is detonated, great certainty is obtained; if the last charge is not detonated, this is indicative of serious problems.

The present apparatus is a detection system to be used with the last charge. Assume that the number of shaped charges required for the string is N where N is a whole number integer. An N+1 shaped charge is added to the string. However, it is not intended to form a perforation in the ordinary operation of the shaped charge assembly. The shaped charge which comprises N+1 charge is used as a signaling charge. It is fired straight down the well borehole for the purpose of interpreting a signal transmitted to the surface. This signal is detected at the surface. The signal presence determines whether or not the N+1 shaped charge has been detonated. If it detonated, this is an indication that the entire string of shaped charges properly detonated. If the transmitted signal persists, this warns the personnel retrieving the shaped charge assembly that live shaped charges remain in the assembly. The risk is markedly clarified.

While the foregoing briefly summarizes the present disclosure, more details will be determined on review of the written specification found below in conjunction with drawings.

DETAILED DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
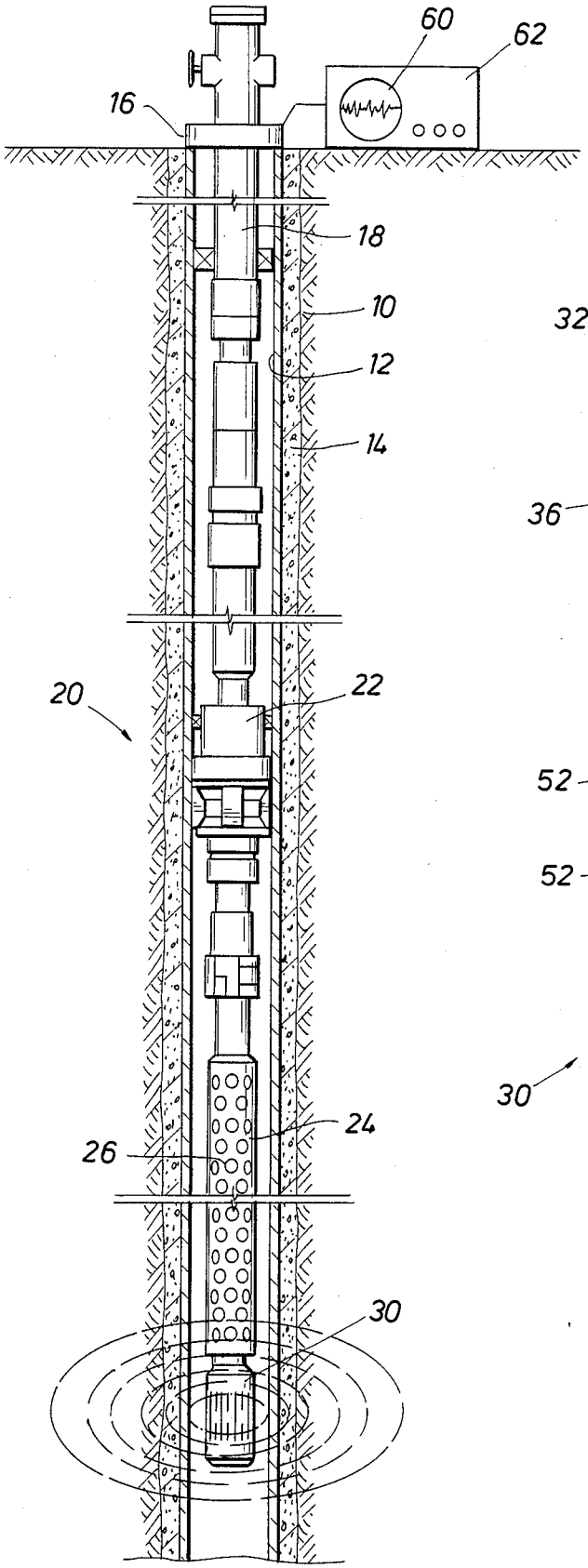
Figure 2:
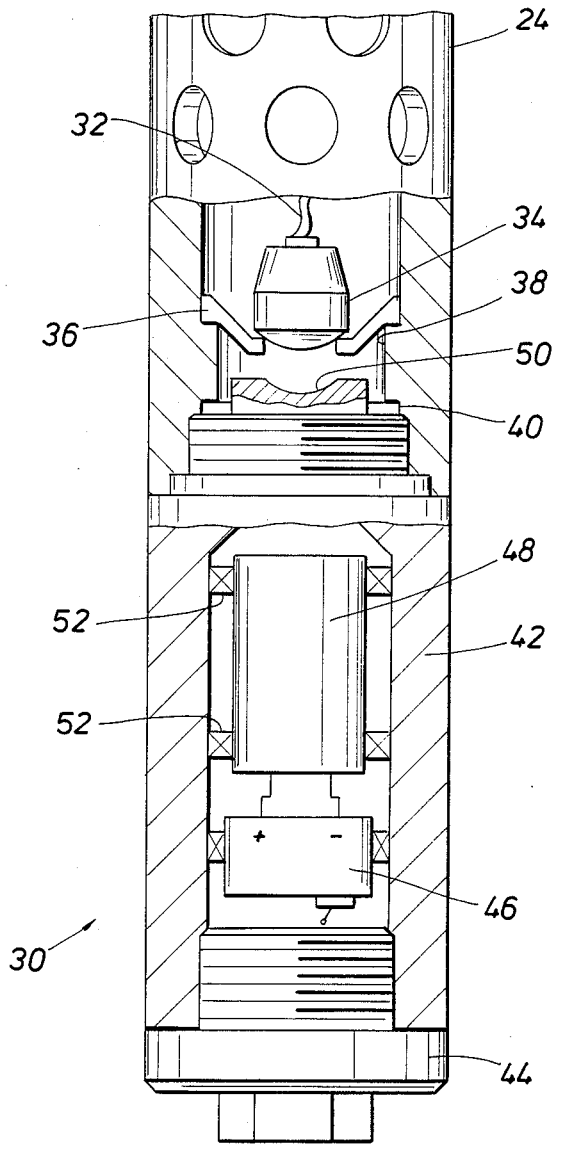

FIG. 1 shows a TCP shaped charged assembly supported in a well borehole and incorporates at the lower end a transmitter assembly in accordance with the teaching of the present disclosure for forming a signal conveyed up the well borehole; and FIG. 2 is a detailed sectional view of the transmitter assembly at the lower end of the shaped charge assembly for forming a signal transmitted to the surface.

DETAILED DESCRIPTION OF THE PREFERRED EMBODIMENT

Attention is first directed to FIG. 1 of the drawings. There, a well borehole 10 has been drilled to the stage where it has been cased with a casing 12. The casing 12 is cemented in place by an annular sleeve of cement at 14. This secures the casing in place. A suitable wellhead closure device 16 is located at the top of the well. It joins wellhead equipment including the casing 12 by means well known. The numeral 18 identifies a long string of tubing. It is used to convey the TCP assembly 20 to a specified depth in the well. Assume for purposes of discussion that the tubing is several thousand feet in length to locate the TCP assembly 20 at a depth of 10,000 feet. Obviously, it can be lowered to any depth depending on the requirements of the particular well 10.

The TCP assembly 20 seals against the casing 12 at an internally aligned support and seal means 22. Typically, the top end of the TCP assembly lands in a reducer nipple installed to register the gun assembly there below. This well known procedure is used to position the perforating guns having the form of shaped charges at a specified depth in the well opposite particular formations. The perforations are formed into the adjacent formations to enable formation fluid to flow through the perforations into the well for production by suitable techniques.

Ordinarily, a weighted bar is dropped through the tubing 18. When it lands at the top end of the seal means 22, it operates a detonator means (not shown for sake of clarity). The detonator means is well known in the TCP art. The dropped weight starts operation of the apparatus by striking the detonator equipment which ultimately ignites a primer cord. The primer cord extends along the length of equipment below the seal means 22. As shown in FIG. 1, shaped charges are positioned internally of a perforated sleeve 24. There are a number of holes or openings in the sleeve 24 to enable the shaped charges to form jets extending through the openings or perforations to thereby form the necessary perforations through the casing 12, the cement 14 and into the adjacent formations. Several perforations are indicated generally at 26, the number and spacing of perforations being variable depending upon the requirements of the particular well. The sleeve 24 extends downwardly to support a housing 30, the housing 30 enclosing the apparatus better shown in FIG. 2.

In FIG. 2, the sleeve 24 is shown at the lower extremity of the TCP assembly. The sleeve has been broken away to disclose the primer cord 32. The primer cord 32 extends to the last shaped charge in the series of shaped charges, this one being identified by the numeral 34. The shaped charge 34 is supported by a mounting bracket 36. It is axially located in the sleeve 24 to point downwardly. The shaped charge 34 comprises the N+1 shaped charge in the string of charges. Recall that N represents the number of shaped charges which are required for perforating the well. N is selected at the time of assembly of the shaped charged string. The sleeve 24 is thus terminated by the construction shown in FIG. 2 where the N+1 shaped charge 34 is then positioned in the mounting bracket 36 to point downwardly. The sleeve 24 is open at the lower end. In fact, the sleeve is axially formed with a passage 38. The passage 38 opens to a set of threads 40. The threads 40 enable the sleeve to thread to the means 30 fixed below as will be described.

The bracket 36 thus supports in a removable fashion the bottom or N+1 shaped charge 34, enabling the shaped charge to form the perforating jet extending through the opening below into the means 30.

The means 30 comprises a cylindrical housing 42. It is closed at the lower end by a closure plug 44 threaded to the housing 30. This defines an internal chamber. In the chamber, a battery 46 is supported. A cylindrical transmitter housing 48 is also included and encloses a transmitter. The transmitter 48 is provided with power for its operation from the battery 46. Preferably, the battery is a battery having relatively long life, say, 100 hours or more. A suitable battery is a nickel/cadmium type. This provides a relatively constant terminal voltage until the charge is fully drained. The battery includes suitable terminals which contact terminals on the housing 48 for operating the transmitter. The transmitter 48 is thus positioned in the internal cavity within the housing 42 above the battery 46. The top end of the housing 42 includes a neck 50 which is open at the center. It is externally threaded to match the threads 40. This permits the means 30 to be threaded to the sleeve 24 at the mating threads 38.

The interior of the cylindrical housing 42 is closed over by a sacrificial top 50. The top 50 is a disk which is scalloped at the top central portion. That is, it is thinner at the center. The top or closure member 50 faces the shaped charge 34. When the shaped charge is ignited, the plume burns through the disk 50 and penetrates the disk. The disk 50 is destroyed in this operation. The length of the plume is sufficient to puncture through the disk and also to penetrate the transmitter housing 48 to destroy the transmitter. The transmitter is destroyed by this shaped charged plume, thereby terminating operation of the transmitter. The transmitter 48 is thus a throw away device. It is positioned for easy removal from the cylindrical housing 42. Centering rings 52 are included to space the battery 46 and the transmitter housing 48 centrally of the housing 42. This permits easy retrieval of the spent debris in the cylindrical housing.

The transmitter within the housing 48 is preferably a low frequency transmitter. A typical frequency range is below 100 hertz. Moreover, it need not be powerful, perhaps having an output of perhaps 10 watts or less. Preferably, the transmitter forms a continuous wave (CW) output. It can be modulated as desired. The CW frequency is selected to be a frequency which is readily transmitted through the casing. The CW signal is propagated up the casing to the wellhead. If desired, a suitable modulation signal can be placed on the CW signal. It can be modulated with sine wave, a triangular wave, square wave or the like. The shape of the modulation signal is not critical at all. Moreover, the modulating frequency can be any convenient frequency. The transmitter then transmits the modulated or unmodulated CW signal up the casing. The transmitted signal is observed at the surface by means of a receiver 60 at the surface, the receiver being connected to the wellhead apparatus at the termination of the casing 12. The receiver forms a tone output or alternatively can even include a CRT display at 62. In either form, the signal from the transmitter is received at the surface and is output for observation to assure that the transmitter is operative.

In operation, the transmitter with batteries is installed in the housing 42. This structure is then threaded to the sleeve 24 with the scalloped top 50 therebetween. This provides a seal against intrusion of well fluids into the chamber where the transmitter is located. The equipment is then affixed to the lower end of the sleeve 24 and lowered into the well on the tubing. The TCP assembly is positioned opposite the desired formations. Recall that the TCP gun assembly may include any number of shaped charges. This number is N while the N+1 shaped charge 34 is connected at the lower end of the primer cord.

Preferably, the battery has an operating life of perhaps 100 hours. Once the battery is installed with the transmitter, the transmitter is rendered operative. There is no need to include a switch on the battery or transmitter to switch them off. A continuous signal is transmitted. The equipment is assembled at the surface and lowered with the TCP assembly. When it is landed at the appropriate depth in the well, and the necessary operative steps are completed, the shaped charges are detonated by dropping a weight through the tubing. The weight falls through the tubing and strikes the equipment in the TCP assembly. This accomplishes detonation. This has the form of ignition of the primer cord which conveys ignition along the length of the TCP assembly. This detonates or ignites the N shaped charges. The last of the shaped charges is the charge 34. When the shaped charge 34 is ignited, it forms an explosive plume which punctures the sacrificial top 50 and destroys the transmitter. At this time, the observed signal at the surface is interrupted. That is, the signal goes dead and is no longer received. When the signal stops, the operator at the surface has confirmation that the last shaped charge has been detonated. This is indicative of the fact that the entire string of shaped charges has been detonated.

This enables the TCP assembly to be retrieved after use with a high measure of safety. If the transmitter is destroyed and the signal terminated, this forms a signal indicative of detonation of the shaped charges. On the other hand, if the transmitter continues to operate, it indicates that the lower part of the string of shaped charges has not been detonated. More severe precautions can then be undertaken to protect surface personnel at the time of retrieval of the TCP assembly.

While the foregoing is directed to the preferred embodiment, the scope thereof is determined by the claims which follow.

We claim:

1. Safety apparatus for use in tubing conveyed perforating gun assemblies having N shaped charges arranged to be fired in sequence and further including means for detonating the N shaped charges, comprising:

(a) a generally cylindrically shaped hollow housing member having an upper end and a lower end, said upper end adapted to be connected to a tubing string for conveyance into a cased well to be perforated and said lower end being provided with a chamber therein for housing a signal transmitter means for forming a signal which is coupled to the tubing string for transmission to the surface;

(b) surface means for detecting the signal from said signal transmitter and for providing indications thereof; and (c) means for interupting said signal transmitting means after the detonation of said N shaped charges.

2. The apparatus of claim 1 wherein said means for interupting includes an N+1 shaped charge positioned to destroy said transmitter means.

3. The apparatus of claim 2 including a hollow housing for receiving said transmitter means therein, and means for positioning said housing adjacent to the N+1 shaped charge for destruction of the contents of said housing.

4. The apparatus of claim 3 including means for providing electrical power to said transmitter means for continuous operation thereof.

5. The apparatus of claim 4 wherein said electrical power means comprises a battery having a specified life for operation of said transmitter means.

6. The apparatus of claim 1 including a cylindrically shaped housing means having a hollow chamber therein for receiving said transmitter means therein, and a separable closure means over said housing, said closure means providing a temporary seal of said housing and wherein said closure means is positioned to be destroyed by an N+1 shaped charge connected serially to the end of N shaped charges to be the last shaped charged detonated thereby.

7. The apparatus of claim 1 including means suspending an N+1 shaped charge to form a jet plume down a well borehole, said N+1 shaped charge being connected to a primer cord for detonation, and wherein said primer cord is connected to detonate the first N shaped charges prior to detonation of the N+1 shaped charge.

8. The apparatus of claim 7 including means positioning said transmitter means in axial alignment relative to the jet plume, sufficiently close to destroy said transmitter means.

9. The apparatus of claim 8 including a sacrificial disk over said transmitter means.

10. The apparatus of claim 9 including sealable chamber means cooperative with said disk to form a closed chamber means for said transmitter means.

11. The apparatus of claim 10 including a battery for said transmitter means in said chamber means.

* * * * *